United States Patent [19]

Tsao et al.

[11] 4,174,976

[45] Nov. 20, 1979

[54] ACID HYDROLYSIS OF CELLULOSE TO YIELD GLUCOSE

[75] Inventors: George T. Tsao; Michael R. Ladisch; Arindam Bose, all of West Lafayette, Ind.

[73] Assignee: Purdue Research Foundation, West Lafayette, Ind.

[21] Appl. No.: 884,478

[22] Filed: Mar. 8, 1978

[51] Int. Cl.[2] ..... C13K 1/02

[52] U.S. Cl. ..... 127/37

[58] Field of Search ..... 127/37

[56] References Cited

U.S. PATENT DOCUMENTS

| | | | |
|---|---|---|---|
| 2,323,022 | 6/1943 | Ferrari | 127/37 |
| 2,752,270 | 6/1956 | Specht | 127/37 |
| 2,945,777 | 7/1960 | Riehm | 127/37 |
| 4,058,411 | 11/1977 | Bellamy | 127/37 |

*Primary Examiner*—Sidney Marantz

*Attorney, Agent, or Firm*—John R. Nesbitt

[57] ABSTRACT

A process to yield glucose from cellulose through acid hydrolysis. Cellulose is recovered from cellulosic materials, preferably by pretreating the cellulosic materials by dissolving the cellulosic materials in Cadoxen or a chelating metal caustic swelling solvent and then precipitating the cellulose therefrom. Hydrolysis is accomplished using an acid, preferably dilute sulfuric acid, and the glucose is yielded substantially without side products. Lignin may be removed either before or after hydrolysis.

8 Claims, No Drawings

ACID HYDROLYSIS OF CELLULOSE TO YIELD GLUCOSE

The Government has rights in this invention pursuant to Contract No. E(11-1)-2755 awarded by the United States Energy Research and Development Administration.

FIELD OF THE INVENTION

This invention relates to acid hydrolysis of cellulose and, more particularly, relates to a process for yielding glucose through acid hydrolysis of cellulose.

BACKGROUND OF THE INVENTION

The utilization of cellulosic waste materials, such as cornstalks, sawdusts, straws, bagasse, and the like, has been the subject of strong interest recently, particularly with respect to utilization of such waste materials for developing alternate sources of fuels, feedstuffs, chemicals and other useful products.

Cellulosic materials include the principal components—cellulose, hemicellulose and lignin. Methods for extraction of hemicellulose have heretofore been suggested and/or utilized and such extracted hemicellulose can be utilized by many existing methods including hydrolysis, fermentation, pyrolysis, and the like.

Lignin has also been isolated from cellulosic materials and since it is higher in hydrogen and carbon and lower in oxygen content than cellulose and hemicellulose it has the highest fuel utility of the three. Isolated lignin can be burned to generate steam and electricity and can also be used to produce a number of useful products including vanillin, dimethylsulfoxide, dimethyl sulfide, and methyl mercaptan and catechol.

Recovery of cellulose and/or utilization of the same, as by hydrolysis to provide glucose, has presented a problem heretofore primarily due to the crystalline structure of the cellulose molecules and the presence therein of a lignin seal.

Attempts have been made to hydrolyze cellulose, and these attempts have included the use of acids or enzymes, but such attempts have not been completely successful, at least not in providing an economically attractive method that is capable of providing a satisfactorily high yield of glucose for the cellulose in such cellulosic materials.

Also, while solvents have been suggested and/or utilized in conjunction with cellulosic materials, improvements in such solvents can still be utilized in recovering cellulose. In this regard, dissolution of pure cellulose using a ferric sodium tartrate based solvent has been heretofore suggested.

SUMMARY OF THE INVENTION

This invention provides an improved process for hydrolysis of cellulose to yield glucose. In the process of this invention, acid hydrolysis of cellulose is effected to yield glucose with the cellulose being recovered from cellulosic materials through treatment of the cellulosic materials to disrupt the structure thereof prior to acid hydrolysis. Lignin is removed either before or after hydrolysis.

It is therefore an object of this invention to provide an improved process for hydrolysis of cellulose to yield glucose, while minimizing formation of undesirable side products.

It is another object of this invention to provide a process for acid hydrolysis of cellulose to yield glucose.

It is still another object of this invention to provide a process for acid hydrolysis of cellulose to yield glucose wherein cellulosic materials are pretreated to disrupt the crystalline structure prior to acid hydrolysis.

With these and other objects in view, which will become apparent to one skilled in the art as the description proceeds, this invention resides in the novel method substantially as hereinafter described, and more particularly defined by the appended Claims, it being understood that such changes in the precise embodiment of the herein disclosed invention are meant to be included as come within the scope of the Claims.

DESCRIPTION OF THE INVENTION

As is well known, cellulosic materials have a highly ordered crystalline structure. In addition, in cellulosic materials, lignin in middle lamella poses as a physical seal surrounding the cellulose fibers in such materials.

In the process of this invention, acid hydrolysis is utilized to yield glucose from cellulose. Cellulosic materials are preferably pretreated to disrupt the crystalline structure and the cellulose precipitated therefrom prior to acid hydrolysis.

The pretreatment of the cellular materials can be accomplished by selective solvent extraction as follows: cellulosic materials are first extracted with a dilute acid or alkali to remove hemicellulose; the residue is then dissolved in Cadoxen made up of 25 to 30% ethylenediamine and 70 to 75% water with about 4.5 tp 7% cadmium added as oxide or hydroxide (for example, about 10 grams of cellulose may be dissolved in 100 grams of Cadoxen); separating lignin, which does not dissolve, from the cellulose-Cadoxen mixture by filtration or centrifugation; and precipitating cellulose from the cellulose-Cadoxen mixture (as by adding water or an acid).

In addition, the cellulosic materials may be pretreated by contacting the materials with a chelating metal caustic swelling solvent. Such an agent may include an aqueous solution of 17% sodium tartrate, 6.6% ferric chlorideand 7.8% caustic which is stabilized by 6.2% sodium sulfite (all in weight percent). While particularly, such an agent may be formed by:

| | |
|---|---|
| $FeCL_3\ 6H_2O$ | about 10 g |
| Tartaric Acid | about . |
| NaOH | about 22 g |
| $Na_2SO_3$ | about 13 g |
| + water | to a total of 200 g. |

The pretreatment of the cellulosic materials in this case involves contacting the materials with solvent in a 1 to 4 weight ratio of residue to solvent.

The acid hydrolysis of cellulose can be envisioned as a sequential reaction:

$$A \xrightarrow{k1} B \xrightarrow{k2} C$$

where A is cellulose, B is glucose, and C is undesirable side products. Reports on the acid hydrolysis of woods, based on research conducted during World War II by J. F. Saeman of the U.S. Forrest Products Laboratory, states that the rate of $A \xrightarrow{k1} B$ is about the same as $B \xrightarrow{k2} C$. In other words the formation of side products from glucose occurred at about the same rate as formation of glucose from cellulose. Consequently, the maximum glucose level in the hydrolysate was only 23% of the sugar potentially available from the cellulose. Over the years some improvements in yields have been obtained by reducing reaction times, increasing temperature and pressure, and modifying processing equipment. Yet with all these improvements, the best yields obtained to date, using this "conventional" technology, are less than 50%.

We have found that microcrystalline cellulose dissolved in the solvent Cadoxen can be converted, almost instaneously, to glucose and other soluble products when concentrated sulfuric acid is added. Using an acid: cadoxen/cellulose ratio of 10:1, a 69% yield of glucose was obtained within 1 minute after the two solutions were mixed together. Therefore, under the right conditions, cellulose dissolved in a solvent such as Cadoxen is very susceptible to acid hydrolysis and gives good yields of glucose.

Although the quantity of acid necessary to produce glucose as discussed is not practical on a large scale, the results achieved show that high conversions of cellulose to glucose can be obtained by acid hydrolysis if the cellulose is in the proper form. In this case the cellulose was dissolved and therefore its physical structure may be considered as being completely disrupted. Herein lies the key to quantitive saccharification of cellulose by acid hydrolysis in that the cellulose when subjected to such hydrolysis must be much less strongly crystallized than it naturally occurs. Starch, another polymer of glucose, which is much less strongly crystallized in its natural state than cellulose, gives very few degradation products and almost quantitative yield of glucose when hydrolyzed with acid. This implies that in the reaction scheme $A \xrightarrow{k_1} B \xrightarrow{k_2} C$ for oligosaccharides, $k_1$ is much greater than $k_2$ when a less strongly crystallized substrate is used.

In the case of acid hydrolysis of cellulose using concentrated acid, the glucose formed must be separated from the acid. To avoid this potentially formidable separation step, a process using dilute acid is preferred. The acid hydrolysis using a dilute acid is carried out in a closed vessel at 100° to 200° C. in an approach similar to that proposed by Saeman in 1945. However, the cellulose is preferably first pretreated in the manner as described hereinabove.

To test the validity of this approach, the following examples were performed:

EXAMPLE 1

Untreated microcrystalline cellulose was hydrolyzed with 0.1% $H_2SO_4$ at 125° C. for 42 hours and gave 8% yield of glucose. Liquid chromatographic analysis of the hydrolysate showed formation of side product. In comparison, the same material, pretreated by dissolution in Cadoxen followed by reprecipitation, and washing, gave 13% conversion to glucose with no apparent formation of side products when hydrolyzed under similar conditions as used for the untreated cellulose.

EXAMPLE 2

Untreated and pretreated cellulose were subjected to hydrolysis using ca. 5% $H_2SO_4$ at 125° C. in a closed vessel. At the end of three hours, the untreated cellulose showed only 18% conversion to glucose while the pretreated cellulose showed 29% conversion to glucose. Lignin may be separated by filtration or centrifugation either before or after hydrolysis.

These examples clearly indicate that pretreatment of cellulose followed by acid hydrolysis (using relatively mild conditions) greatly enhances the conversion to glucose. Acid hydrolysis of cellulose is of economic importance since presently the only way to obtain quantitative yields of glucose from cellulose without side product formation is to use cellulase enzymes. This enzyme is costly and constitutes a major operating expense in the saccharification of cellulose. With the process of this invention, saccharification of cellulose can be accomplished using inexpensive acid instead of costly enzyme, and this reduces the price of making glucose from cellulose.

Although sulfuric acid was used in the above examples, other acids, such as, for example, hydrochloric and phosphoric acids, could just as well be used. Or, instead of mineral acids, organic acids may also be used to carry out the hydrolysis.

Thus from the foregoing, it can be appreciated that this invention provides an improved process for acid hydrolysis of cellulose.

What is claimed is:

1. A process for hydrolyzing the cellulose in a cellulosic material to obtain glucose therefrom comprising:

contacting the cellulosic material either with a solvent comprising ethylenediamine, cadmium hydroxide and water or with a solvent comprising a chelating metal caustic swelling agent whereby the solvent dissolves the cellulose to form a solution, precipitating the cellulose from the solution; and hydrolyzing the precipitated cellulose with acid to obtain glucose.

2. The process of claim 1 wherein the solution is separated from any non-soluble non-cellulosic portion of the cellulosic material before precipitating the cellulose.

3. The process of claim 1 wherein said acid is selected from the group consisting of mineral and organic acids.

4. The process of claim 1 wherein said acid is selected from the group of mineral acids consisting of sulfuric acid, hydrochloric acid, and phosphoric acid.

5. The process of claim 1 wherein said acid hydrolysis is practiced at a temperature range of ambient to about 200° C.

6. The process of claim 1 wherein said acid hydrolysis is carried out in a closed vessel at a temperature of between 100° C. and 200° C.

7. The process of claim 1 wherein lignin is separated from said glucose by filtration or centrifugation.

8. The process of claim 1 wherein lignin is separated from said precipitated cellulose before hydrolysis to yield glucose.

* * * * *